US012016500B2

(12) United States Patent
Tran

(10) Patent No.: US 12,016,500 B2
(45) Date of Patent: Jun. 25, 2024

(54) SOAP HOLDER

(71) Applicant: Tran & Tran Holding GmbH, Ursensollen (DE)

(72) Inventor: Phuc-An Tran, Amberg (DE)

(73) Assignee: TRAN & TRAN HOLDING GMBH, Ursensollen (DE)

( * ) Notice: Subject to any disclaimer, the term of this patent is extended or adjusted under 35 U.S.C. 154(b) by 224 days.

(21) Appl. No.: 17/682,556

(22) Filed: Feb. 28, 2022

(65) Prior Publication Data

US 2022/0296050 A1 Sep. 22, 2022

(30) Foreign Application Priority Data

Nov. 30, 2021 (DE) ..... 10 2021 131 419.4
Feb. 21, 2022 (EP) ..... 22157820

(51) Int. Cl.
*A47K 5/05* (2006.01)

(52) U.S. Cl.
CPC ..... *A47K 5/05* (2013.01); *A47K 2201/02* (2013.01)

(58) Field of Classification Search
CPC ..... A47K 5/05; A47K 2201/02
USPC ..... 248/682, 683, 686, 684, 309.4
See application file for complete search history.

(56) References Cited

U.S. PATENT DOCUMENTS 3,472,391 A * 10/1969 Bolognesi ..... A47K 5/05 248/309.4
3,552,705 A * 1/1971 Caster ..... A47K 5/05 248/309.4
5,368,268 A * 11/1994 Jodwischat ..... A47K 5/05 248/309.4
6,929,232 B1 * 8/2005 Gasperi ..... A47K 5/05 248/309.4
6,966,445 B1 11/2005 Johanna
2008/0210650 A1 * 9/2008 Springer ..... A47K 5/05 211/85.12
2011/0101199 A1 * 5/2011 Andrade ..... A47K 5/05 248/686
2014/0299731 A1 10/2014 Kim et al.

FOREIGN PATENT DOCUMENTS

DE 202017007064 U1 6/2019
DE 202020107614 U1 3/2021
EP 0276830 A1 8/1988
FR 2787154 A1 6/2000
KR 20-2011-0001905 2/2011
KR 20110001905 U 2/2011

* cited by examiner

*Primary Examiner* — Muhammad Ijaz
(74) *Attorney, Agent, or Firm* — Bryan W. Bockhop; Bockhop Intellectual Property Law, LLC

(57) ABSTRACT

A soap holder device includes a holder having a first magnetic element and a second magnetic member adapted to be pressed into a soap. The holder includes a first region in which a conically shaped lip forms a suction cup, and a second portion located radially inward of the first portion and axially spaced from the first portion. The second portion is adapted to hold the first magnetic member in a radial direction by means of a wall portion and in an axial direction by means of a roof portion in a direction opposite to the first portion. The tapered lip of the first portion decreases in diameter toward the second portion. In use, the second magnetic member is detachably disposed on the roof portion of the second portion.

17 Claims, 6 Drawing Sheets

SOAP HOLDER

CROSS-REFERENCE TO RELATED APPLICATION(S)

This application claims the benefit of following patent applications, the entirety of which is hereby incorporated herein by reference: German Patent Application No. DE 10 2021 106 706.5, filed on 18 Mar. 2021; German Patent Application No. DE 10 2021 108 302.8 31, filed on March 2021; German Patent Application No. DE 10 2021 131 419.4, filed on 30 Nov. 2021: and European Patent Application No. EP22157820.6, filed on 21 Feb. 2022.

BACKGROUND OF THE INVENTION

1. Field of the Invention

The present invention relates to a soap holder device that keeps a soap dry and clean, is easy to clean, and avoids unnecessary contamination.

2. Description of the Related Art

Liquid or solid soap may be used for personal hygiene and hand washing. A solid soap has the advantage of being economical while having a good cleaning effect and, unlike liquid soap, requires almost no packaging. However, a solid soap has the disadvantage that it softens in a soap dish. In addition, staining is caused by drops of water or lye around the sink when you reach for the soap on the washstand or sink edge with your hand.

It is known to hold a soap by means of a combination of a magnet attached to a soap holder and a magnetic element, for example a small plate, pressed into the soap. This allows the soap to be installed, for example, in the area of a sink into which water is introduced from a faucet. However, constant contact of the magnet with moisture can cause it to corrode (rust).

Therefore, there is a need for an improved soap holder device.

SUMMARY OF THE INVENTION

The object of the invention is solved by a soap holder device according to claim 1. The soap holder device comprises a holder having a first magnetic element. The soap holder device includes a second magnetic member adapted to be pressed into a soap. The holder comprises a first region in which a conically shaped lip forms a suction cup. The holder comprises a second region located radially inward of the first region and axially spaced from the first region. The second region is configured to hold the magnetic element in a radial direction by means of a wall region and in an axial direction by means of a roof region in a direction opposite to the first region. The conically shaped lip of the first region reduces its diameter in the direction of the second region. In use, the second magnetic member is detachably disposed on the roof portion of the second region.

In the axial direction, the first magnetic element is located above the suction cup. In the radial direction, the first magnetic element is located in the center of the suction cup. The suction cup is open towards the bottom. The first area and the second area of the holder are formed in one piece. The second magnetic element is arranged on the holder axially above the magnet. Between the first magnetic member and the second magnetic member is arranged the roof portion, which is made of the same material as the suction cup. The holder may be made of plastic, for example a thermoplastic polymer.

The second magnetic element is pressed into a soap preferably below its center of gravity. The soap can be removed from the holder by means of the second magnetic element, and after use of the soap can be fixed to the holder again by means of the second magnetic element. It is an advantage of the invention that the soap floats, i.e., the soap is held without support from below. The soap can dry on all sides without contaminating a sink or dish.

The second region may be substantially tub-shaped. An open end of the second region is formed in an axial direction toward the first region. The open end is directed axially downward and is surrounded by the suction cup. In other words, the inner portion of the suction cup adjoins the open end of the second portion. The wall portion of the substantially tub-shaped second portion is formed to project away from an inner end of the first portion in an axial direction. The wall portion projects axially upwardly from the inner end of the suction cup. The axially closed end of the tub-shaped second portion is axially opposite to the first portion. The end closed in the axial direction is the roof portion. The roof region is located above the center of the suction cup in the axial direction.

The first magnetic member may comprise any shape, for example rectangular, square, cylindrical, etc., with the cylindrical shape being preferred. The cylindrical shape of the first magnetic element reduces manufacturing efforts.

The first magnetic element may be a permanent magnet. The second magnetic element may comprise a ferromagnetic material, such as iron.

The tub-shaped portion may be substantially cylindrical in shape at its outer contour. On the one hand, the soap holder device is easier to manufacture if the tub-shaped portion comprises a cylindrical outer contour. It is understood that the tub-shaped portion is formed as a cylinder open on one side. The tub-shaped portion is open in the axial direction toward the suction cup. In other words, the suction cup is arranged at the lower end of the downwardly open tub-shaped region.

The inner cross-section of the second area can be designed to taper in the axial direction towards the roof area of the second area, i.e. the inner cross-section or inner diameter reduces at an axial distance from the first area. This reduces the axial compressive force on the roof region when the second magnetic member is separated from the first magnetic member.

The inner cross-section of the second area may be at least partially smaller in radial direction than the inner cross-section of the first magnetic element. The first magnetic element can be a cylinder with a constant radius. This creates a hold without a positive substance jointing, such that the second magnetic element cannot move in the second area. A certain amount of radial traction is applied to the roof area, which biases the roof area in the radial direction. However, since the first magnetic element cannot move in the second region, when the second magnetic element is removed from the roof region, no pressure is applied to the roof region in the axial direction.

The first magnetic element need not necessarily be cylindrical in shape. In one embodiment, the first magnetic element may be configured such that the cross-section increases from the first region to the roof region, for example conically. Provided that the cross-section of the first magnetic element is larger, at least at one location, than the internal cross-section of the second region located at the same location, no appreciable axial compressive force acts on the roof region when the second magnetic element is removed from the roof region.

The inner cross-section of the second region may be tapered in the axial direction toward the first region, i.e., the inner cross-section or inner diameter increases in axial distance from the first region. The inner cross-section of the second area can be at least partially smaller in radial direction than the inner cross-section of the first magnetic element. The first magnetic element can be a cylinder with a constant radius. This creates a hold without positive substance jointing, such that the first magnetic element cannot move in the second region. In this embodiment, the first magnetic element is held immobile without the need for positive substance jointing. Also, with this taper, there is no axial compressive force on the roof portion by the first magnetic element when the second magnetic element is pulled away from the roof portion. The first magnetic element exerts no axial compressive force on the roof region directly below the roof region because the first magnetic element is held in position by the taper toward the first region. The hold causes the first magnetic element to be immobile, such that no axial force is exerted on the roof region when the second magnetic element is withdrawn. Furthermore, no radial force (in particular, no radial traction force) is exerted on the roof region, since directly below the roof region the first magnetic element does not contact the wall region.

In the second area, a circumferential sealing lip can be arranged at the opening opposite the roof area, which extends radially inwards from the wall area. This sealing lip can fix the first magnetic element against the roof region and wall region of the second region. Furthermore, excessive water ingress between the first magnetic element and the wall area, for example during cleaning, is avoided.

The suction cup may comprise a greater thickness (wall thickness) at a radially inner region than at a radially outer region. In other words, the thickness of the suction cup decreases in the radially outward direction. This may allow the suction cup to carry a greater load and conform to a contour to which the suction cup is intended to adhere.

The second magnetic member may comprise a first portion extending in a first direction and configured to abut, in use, the roof portion of the second portion. The second magnetic member comprises protrusions extending from the first portion in a direction toward the soap body and opposite the direction of the retainer. The protrusions may extend approximately perpendicular to the first portion of the second magnetic member. The protrusions comprise a thickness that is less than the thickness of the first portion, at least in a partial region thereof. The partial area of the protrusion with the lower thickness may comprise an area of at least 20%, preferably at least 30%, more preferably at least 40% of the total area of the respective protrusion. The portion of the protrusion with the lower thickness may comprise a thickness that is at least 10%, preferably at least 15%, lower than another portion of the protrusion. By forming the protrusions thinner, it is ensured that the second magnetic member can be easily pressed into the soap. The thick-walled first section achieves a higher attractive force compared to a thin-walled formation of the first section. The protrusions may be inclined outwardly away from the center of the second magnetic element. The protrusions may be inclined in an angular range from about 89° to about 80°, more preferably from about 89° to about 75° with respect to the central plane of the first portion of the second magnetic element.

A protrusion may be semicircular, triangular, rectangular, or any other shape. In one embodiment, the protrusions may be semi-wavelike or wavelike in shape.

The protrusions may be circumferentially disposed on the outer edge of the first section, and at least one protrusion may comprise an undercut. The undercut improves the retention of the second magnetic element in the soap. In addition, when the second magnetic element is pressed into the soap, the risk of damage to the soap is reduced.

In one embodiment, the undercut of the at least one protrusion may be formed in the circumferential direction of the first portion of the second magnetic element, which corresponds to the width direction of the protrusion. The undercut may be angular or rounded in shape. The undercut may extend at least 10%, preferably at least 20%, more preferably at least 40% of the maximum width of the protrusion in the width direction of the protrusion from each side of the protrusion.

The roof portion may comprise a first profile on its surface directed toward the second magnetic member. The first portion of the second magnetic member may include a second profile on its surface directed towards the roof element. The second profile is complementary to the first profile. This increases friction between the roof portion and the second magnetic member. The first profile and the second profile may be formed such that they interlock with each other. In one embodiment, the first profile may comprise an undercut such that a latching action is achieved.

The first profile may comprise a protrusion, such as an elevation. The second profile may comprise a recess. The recess may be an indentation or an opening.

The first profile may comprise a land, a substantially circular land, a substantially partial circle land, a plurality of lands, a plurality of circular lands, a plurality of semicircular lands, or the like. The second profile may comprise a substantially semicircular opening, a plurality of semicircular openings, an indentation, a substantially circular indentation, a substantially semicircular indentation, a plurality of indentations, a plurality of circular indentations, a plurality of semicircular indentations, or the like. It is understood that any combination of the webs may be formed, as well as any action of the indentations and/or openings.

In one embodiment of the soap holder device, the second region may fluid-tightly surround the first magnetic member from all sides. In other words, the first magnetic element is also enclosed at the bottom by the second region. In this embodiment, no liquid, gas, water vapor or the like can reach the surface of the first magnetic element. Thus, corrosion of the first magnetic element can be avoided. The second region may be formed as a hollow cylinder within which the first magnetic element is located. The hollow cylinder forming the second region encloses the first magnetic element.

For example, this embodiment may be manufactured using an injection molding process such that the first magnetic element is enclosed with a suitable plastic, for example a thermoplastic polymer, during an injection molding process.

In one embodiment, the soap holder device may comprise a third magnetic element disposed below the first magnetic element and having a larger cross-section or larger diameter than the inner diameter of the second region. This may prevent the first magnetic element from moving toward the roof portion when the second magnetic element is pulled away from the roof portion. This embodiment allows the user to assemble and disassemble the soap holder device itself. The third magnetic element may be ferromagnetic.

The third magnetic element may be disc-shaped, for example, cylindrical disc-shaped.

The outer periphery of the third magnetic element may press against the inner portion of the first portion. This also prevents the first magnetic member from moving toward the roof portion when the second magnetic member is pulled away from the roof portion. Further, the soap holder device is perceived by a user to be more stable to handle. In this embodiment, the third magnetic element is located within the first region.

The third magnetic element may comprise a protrusion that extends into a first groove in the second region. This fixes the third magnetic element particularly securely in the radial direction. The protrusions may be formed at the radially outer end of the third magnetic element, which is substantially circular in shape. The protrusions may extend upward in the radial direction. The first groove may be formed in an annular shape in the first region. The first groove may comprise a width smaller than the thickness of the protrusion in the radial direction, which may ensure that the first groove frictionally holds the protrusion of the third magnetic element.

The soap holder device may comprise a receiving element that receives the edge of the third magnetic element on the inner side of the receiving element in a form-fit manner. As a result, the receiving element need not be bonded to the first region and/or the second region.

The third magnetic element may have a substantially cylindrical disk shape. The receiving element extends in a U-shaped cross-section around the radially outer edge of the third magnetic element.

In one embodiment, the outer surface of the receiving element may be frictionally coupled to the inner surface of the first region. In another embodiment, the outer surface of the receiving element may be positively coupled to the inner surface of the first region.

A second annular groove may be disposed in the wall portion of the soap holding device, extending axially upwardly from the first portion and spaced from the first magnetic member. At least a portion of the receiving element, for example the radially outer portion of the receiving element, may be received by the second annular groove in a form-fit manner. In this embodiment, the third magnetic element is inserted into the receiving element and the combination of receiving element and third magnetic element is inserted into the second annular groove.

A projection may extend from the receiving element into the first region on the side facing away from the second region. The protrusion may be convexly curved. The protrusion may prevent the second magnetic element from moving out of the second region toward the first region when the soap holder device is attached to a wall, sink, or other object by means of the first region.

In another embodiment, the third magnetic element or optional holding element connected to the first magnetic element may be supported by an optional flexible adhesive element inserted into the first region. This adhesive element generates a counterforce on the connected first magnetic element and the third magnetic element when pressure is applied to the roof area. This embodiment has the advantage that the adhesive element can be flexibly adapted depending on whether it is attached to a flat, convex or concave surface, since the distance from the third magnetic element and the adhesive element to the application surface varies depending on the shape of the application surface and can thus be adapted thereto. The flexible adhesive element may adhere to the underside of the third magnetic element or to the underside of the receiving element by adhesive action. In another embodiment, the adhesive element may be disposed on the underside of a sealing portion or on the underside of the first magnetic element, wherein the adhesive element adheres to the underside of the sealing portion or to the underside of the first magnetic element by adhesive action.

In one embodiment, the soap holder device may comprise a fourth magnetic element disposed in the tub-shaped region between the roof region and the first magnetic element. The fourth magnetic element may be ferromagnetic. The fourth magnetic element may be a permanent magnet. Consequently, the first magnetic member and the fourth magnetic member adhere to each other.

The tub-shaped portion may comprise an upper portion at an upper portion facing the roof member, and a lower portion at its lower portion facing away from the roof member. The first magnetic member may be disposed in the lower portion of the tub-shaped area, and the fourth magnetic member may be disposed in the upper portion of the tub-shaped area. This may prevent the first magnetic member from moving toward the roof portion when the second magnetic member is pulled away from the roof portion. This may extend the life of the soap holder device and facilitate handling by the user.

In one embodiment, the soap holder device may comprise a fifth magnetic element disposed between the roof portion and the second magnetic element. The fifth magnetic element may comprise the same dimensions and/or diameter and/or shape as the second magnetic element. If the fifth magnetic element comprises protrusions such as the second magnetic element, the fifth magnetic element is arranged at the roof portion such that the protrusions are directed toward the first portion but do not contact the first portion. The fifth magnetic element may have a cylindrical disk shape. Projections may be formed on the fifth magnetic element to prevent displacement of the fifth magnetic element. The fifth magnetic element may be ferromagnetic.

The soap holder device may comprise a cap member disposed over the roof portion and on at least a portion of the wall portion. The cap element may be formed as a downwardly open cylinder disposed over the roof region and at least a portion of the wall region. Radial walls of the cap region may be frictionally retained by the wall region.

These and other aspects of the invention will become apparent from the following description of the preferred embodiments taken in conjunction with the following drawings. As would be obvious to one skilled in the art, many variations and modifications of the invention may be effected without departing from the spirit and scope of the novel concepts of the disclosure.

BRIEF DESCRIPTION OF THE FIGURES OF THE DRAWINGS

The invention is now described in more detail with reference to the accompanying figures, which exemplify non-limiting embodiments of the invention, wherein.

DETAILED DESCRIPTION OF THE INVENTION

Figure 1:
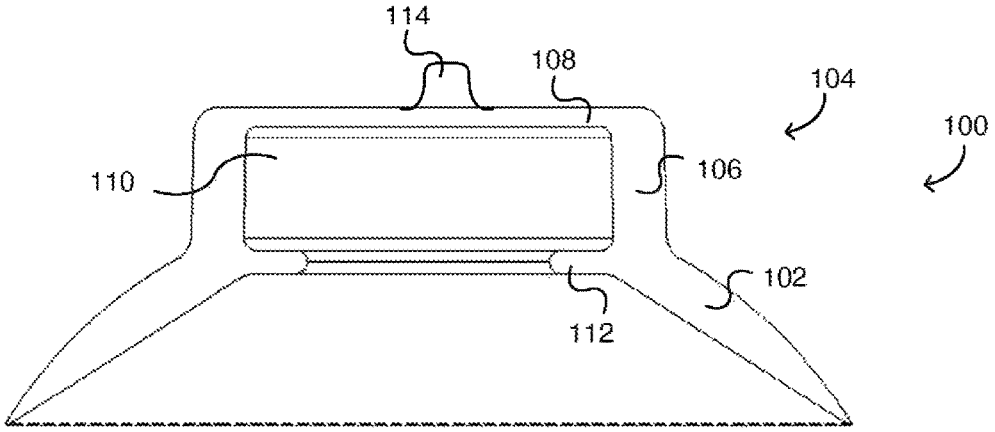
FIG. 1 shows a section through a holder for a soap according to a first embodiment.

A preferred embodiment of the invention is now described in detail. Referring to the drawings, like numbers indicate like parts throughout the views. Unless otherwise specifically indicated in the disclosure that follows, the drawings are not necessarily drawn to scale. The present disclosure should in no way be limited to the exemplary implementations and techniques illustrated in the drawings and described below. As used in the description herein and throughout the claims, the following terms take the meanings explicitly associated herein, unless the context clearly dictates otherwise: the meaning of "a," "an," and "the" includes plural reference, the meaning of "in" includes "in" and "on."

With reference to the figures, the soap holder device according to the invention is described such that a suction cup of the soap holder device is oriented downward. It is understood that spatial orientations are not to be construed as limiting. The figures are not to scale.

FIG. 1 shows a first embodiment of the soap holder device 100 according to the invention in a sectional view. A suction cup 102 is formed in the lower region of the soap holder 100. The thickness of the suction cup 102 decreases in a radially outward direction. This has the advantage that the suction cup 102 comprises, on the one hand, sufficient stability to support heavy loads and, on the other hand, sufficient flexibility to conform to a surface of a body. Extending upwardly in the axial direction from the suction cup 102 is a wall portion 106 which is substantially cylindrical in shape. A roof portion 108 is formed above the wall portion 106, which forms a downwardly open cylinder with the wall portion 106. A sealing lip 112 extends radially inwardly from the upper end of the suction cup 102.

A first magnetic element 110 is disposed within the wall portion 106, the roof portion 108, and the sealing lip 112. In a preferred embodiment, the first magnetic element 110 is a permanent magnet.

The soap holder 100 is integrally formed, preferably of plastic. The roof portion may comprise a thickness between 0.2 mm and 1.5 mm.

Figure 5:
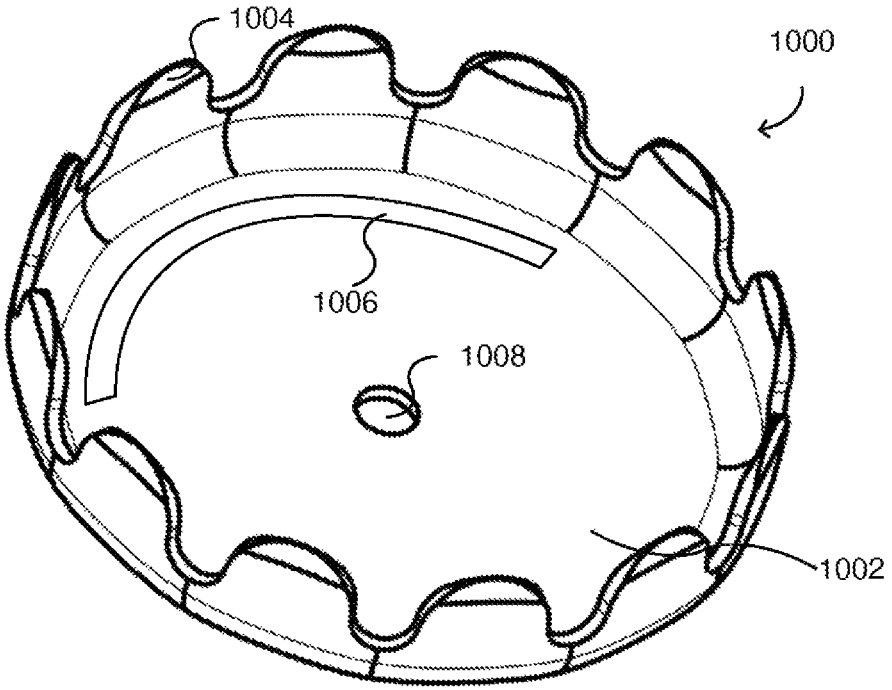
FIG. 5 shows a first embodiment of a magnetic soap holding member.

Reference is made to FIG. 5, which shows a first embodiment of a second magnetic element 1000. The second magnetic element 1000 forms a soap receptacle. The second magnetic element 1000 includes a first portion 1002 formed substantially as a circular disc. The soap receptacle 1000 is made of a ferromagnetic material, such as chromium-plated steel.

Extending from the disk 1002 are protrusions 1004, which in the embodiment shown in FIG. 5 comprise a substantially undulating profile. The protrusions 1004 comprise a thickness less than that of the disk 1002. In particular, the protrusions 1004 may be such that the thickness decreases in the axial direction. In other words, the protrusions 1004 are thinner at their tip than at the base region adjacent to the disk 1002.

In use, the protrusions 1004 are pressed into a soap, preferably below the center of gravity of the soap. In use, the disc 1002 contacts the roof region 108. Preferably, an opening 1008 is formed in the disc, for example in the center, into which a projection 114 in the roof region 108 (see FIG. 1) projects. This improves the stability of the fixation of the soap holder 1000 to the roof area 108.

Figure 7:
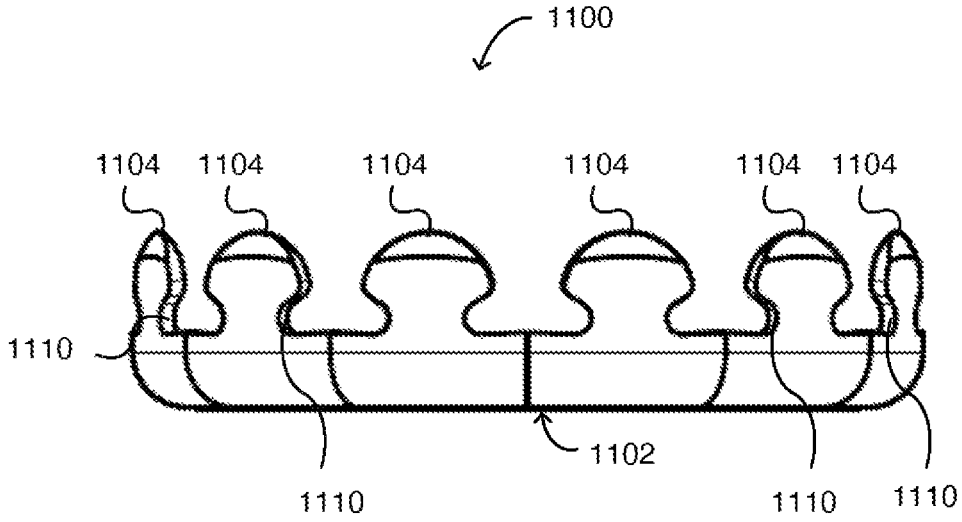
FIG. 7 shows a side view of a second embodiment of the second magnetic element.

Reference is made to FIG. 7, which illustrates a second embodiment of a second magnetic element 1100 acting as a magnetic soap receiving element. The second embodiment of the second magnetic element 1100 is substantially the same as the first embodiment of a magnetic element 1000 shown in FIG. 5. The second embodiment of the second magnetic element 1100 may comprise the same features previously described in connection with the first embodiment of the second magnetic element 1000 shown in FIG. 5.

The second magnetic element 1100 includes a first portion 1102 that is formed substantially as a circular disk. The second magnetic element 1100 is made of a ferromagnetic material, such as chromium-plated steel. Protrusions 1104 extend from the first portion 1102 of the second magnetic element 1100. The protrusions 1104 comprise substantially the wavelike shape previously described in connection with the protrusions 1004 of the first embodiment of the second magnetic element 1000. Additionally, the protrusions 1104 have an undercut in their base portion that is directed toward the first portion 1102. The undercut acts as a barb to hold the protrusions 1104 as firmly as possible in the soap, and thus to hold the entire second magnetic element 1100 as firmly as possible in the soap. The undercut 1110 may be curved in shape, as shown in FIG. 7. However, it is also possible for the undercut 1110 to be angular, rectangular, or any other suitable shape.

In one embodiment, the undercut of the at least one protrusion may be formed in the circumferential direction of the first portion, which corresponds to the width direction of the protrusion. The undercut may extend at least 10%, preferably at least 20%, more preferably at least 40% of the maximum width of the protrusion in the width direction of the protrusion.

The first magnetic element 110 may comprise, at least in part, a larger diameter than the inner diameter of the wall portion 106. This prevents movement of the first magnetic element 110 in the axial direction when the second magnetic element 1000, 1100 is pulled off.

Figure 2A:
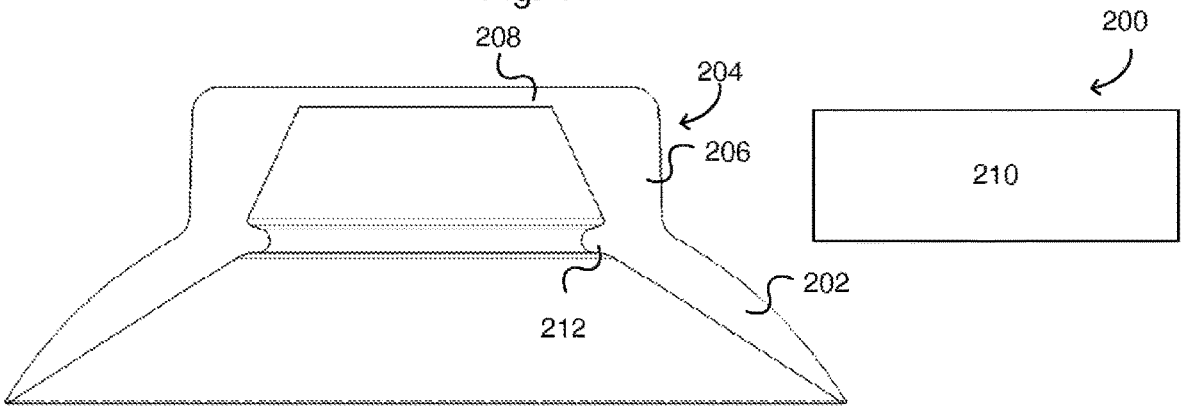
FIG. 2*a* shows a section through a holder for a soap according to a second embodiment.

FIG. 2*a* shows a second embodiment of the soap holder 200 having a suction cup 202, a sealing lip 212, a wall portion 206, and a roof portion 208, which is substantially structurally the same as the embodiment previously described with reference to FIG. 1. The wall portion 206 is tapered such that in the axial upward direction, the thickness of the wall portion increases, with the wall portion 206 being formed cylindrically in its outer contour. In other words, in the axial upward direction, the inner radius of the wall portion decreases. If a cylindrical first magnetic member 210 is pushed between the wall portion 206, the wall portion 206 is biased such that it elastically contracts. Thus, a higher holding force is achieved.

Figure 2B:
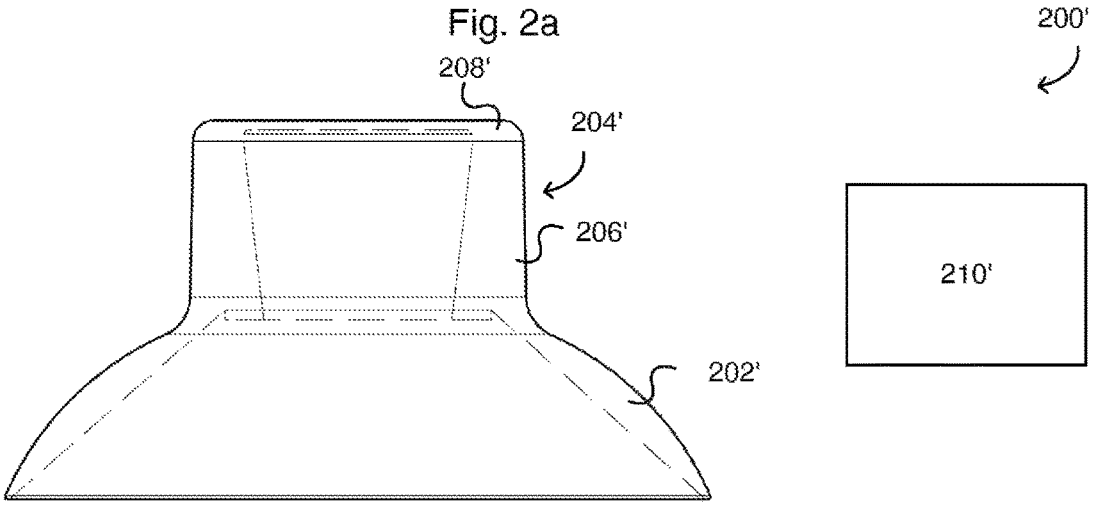
FIG. 2*b* shows a section through a holder for a soap according to a variant of the second embodiment.

FIG. 2*b* shows an modification of the second embodiment of the soap holder 200' having a suction cup 202', a wall portion 206' and a roof portion 208', which is substantially structurally the same as the embodiment previously described with reference to FIG. 1. The wall portion 206' is tapered such that in the upward axial direction the thickness of the wall portion decreases, the wall portion 206' being formed cylindrically in its outer contour. In other words, in the axial downward direction, the inner radius of the wall region decreases. In the event that a cylindrical first magnetic member 210' is sandwiched between the wall region 206', the wall region 206' is biased such that it is perceived by a user to be substantially immobile without the need for positive substance jointing. In this embodiment, the first magnetic element 210' is frictionally retained in the second region 204', whereby no axial compressive force is applied by the first magnetic element 210' to the roof region 208' when the second magnetic element is pulled away from the roof region 208'. Also, a radial force application is not exerted on the roof portion 208', since in the axial direction towards the roof portion 208' the bias decreases.

Figure 3:
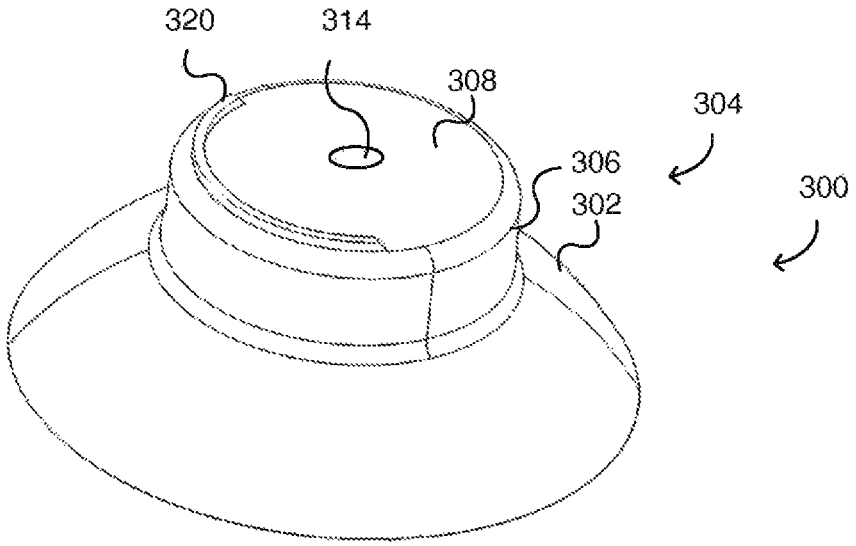
FIG. 3 shows a perspective view of a holder for a soap according to a third embodiment.

Reference is made to FIG. 3, which shows a third embodiment 300 of the soap holder according to the invention. Third embodiment includes a suction cup 302, a wall portion 306, and a roof portion 308. A substantially semi-circular ridge 320 and an elevation 314 are formed on the roof portion 308. The ridge 320 and elevation 314 extend upward in an axial direction. In use, when the soap receptacle 1000 is disposed on the roof portion 308, the elevation 314 extends through the central opening 1008 and the ridge 320 extends through the semi-circular opening 1006, thereby increasing the stability of the fixation of the soap receptacle 1000 to the roof portion 308.

Figure 4:
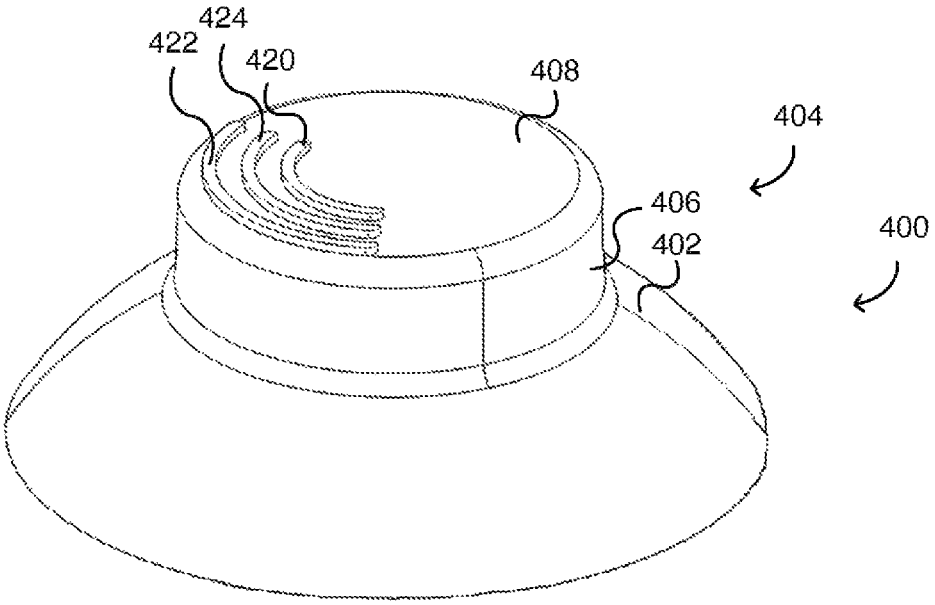
FIG. 4 shows a perspective view of a holder according to a fourth embodiment of the invention.

Reference is made to FIG. 4, which shows a perspective view of the fourth embodiment 400 of the soap holder device according to the invention. The fourth embodiment includes a suction cup, a wall portion 406, and a roof portion 408. A plurality of webs 420, 422, 424 extend axially upward on the roof portion 408. The webs are arranged concentrically in a partial circle. In the embodiment shown in FIG. 4, the webs 420, 422, 424 are quarter webs. It is understood that the webs 420, 422, 424 may comprise any other shape. In use, the webs 420, 422, 424 project through complementary indentations or openings in the disc of the soap receiver (not shown).

Figure 6:
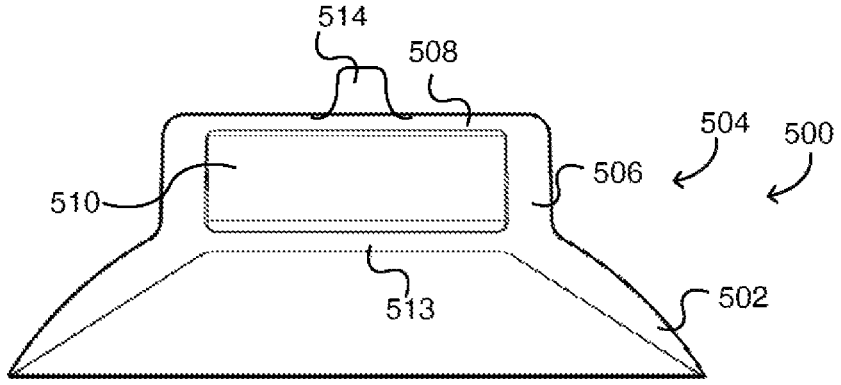
FIG. 6 shows a sectional view of a holder for a soap according to a fifth embodiment.

Reference is made to FIG. 6, which shows a sectional view of a fifth embodiment 500 of the soap holder device according to the invention. The fifth embodiment is substantially the same as the first embodiment 100, and differs from the first embodiment in that a first magnetic element 510 is enclosed on all sides by a second region 504. The fifth embodiment includes a suction cup 502 formed in the lower portion of the soap holder 500. The thickness of the suction cup 502 decreases in a radially outward direction. Extending upwardly in the axial direction from the upper end of the suction cup 502 is a wall portion 506 that is substantially cylindrical in shape.

Above the wall portion 506, a roof portion 508 is formed which forms a cylinder with the wall portion 506 and a sealing portion 513. The sealing region 513 extends radially inwardly from the upper end of the suction cup 502. The first magnetic member 510 is disposed within the second region 504 formed by the roof region 508, the wall region 506, and the sealing region 513. The sealing region 513 extends from the top end of the suction cup 502 and closes the suction cup 502 axially upward at the top end of the suction cup 502, which is the smallest diameter end of the suction cup. The sealing region 513 may also extend radially inwardly from the lower end of the wall region 506, closing the second region 504 downwardly.

At the roof region, a protrusion 514 may extend in the axial direction away from the second region 504, which, in use, extends into the opening 1008 in the disk 1002 of the second magnetic element 1000. It will be understood that in the fifth embodiment, the ridges 320, 420, 422, 424 shown in FIGS. 3 and 4 may alternatively or additionally be formed on the top surface of the roof portion 508.

Figure 8A:
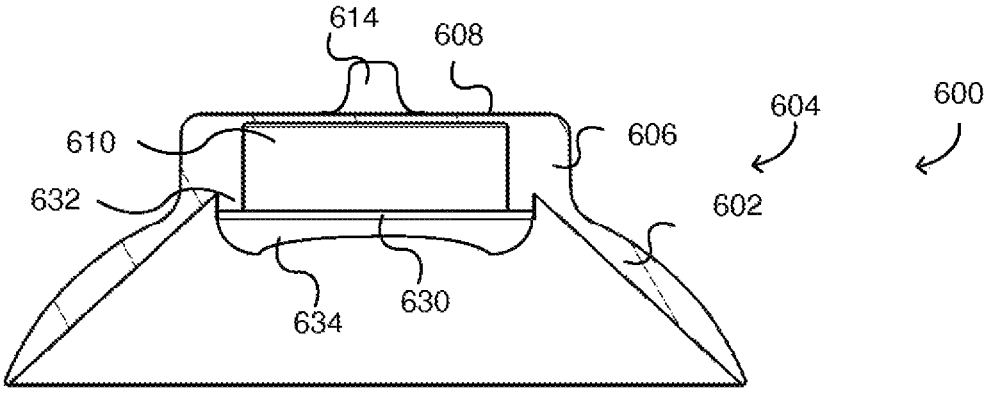
FIG. 8*a* shows a section through a holder for a soap according to a sixth embodiment.

Reference is made to FIG. 8*a*, which shows a sectional view of a sixth embodiment 600 of the soap holder device according to the invention. The sixth embodiment is substantially the same as the first embodiment 100, and differs from the first embodiment in that a third magnetic element 630 is disposed below a first magnetic element 610. The sixth embodiment includes a suction cup 602 formed in the lower portion of the soap holder 600. The thickness of the suction cup 602 decreases in a radially outward direction. Extending upwardly in the axial direction from the upper end of the suction cup 602 is a wall portion 606 that is substantially cylindrical in shape.

Above the wall portion 606, the roof portion 608 is formed which forms a cylinder with the wall portion 606 and the third magnetic element 630. The third magnetic element 630 is formed as a cylindrical disk disposed below the first magnetic element 610. A cylindrical support portion 632 may extend downwardly from the wall portion 606 toward the first portion, and the third magnetic element 630 is disposed at the lower end of the cylindrical support portion 632. The cylindrical support region 632 decouples the forces acting from the suction cup 602 into the wall region 606 from the third magnetic element 630, and the third magnetic element 630 may be held in position by the magnetic attraction force of the first magnetic element 610. It is also possible to have the third magnetic element materially bonded to the wall portion 606 or to the cylindrical support portion 632. The first magnetic element 610 may be frictionally received within the wall portion 606 if the cross-section of the first magnetic element 610 is smaller than the internal cross-section of the wall portion 606.

In another embodiment, the third magnetic element 630 connected to the first magnetic element 610 may be supported by an optional flexible adhesive element 634 inserted into the first region. This adhesive element generates a counterforce on the connected first magnetic element 610 and the third magnetic element when pressure is applied to the roof portion 608. This embodiment has the advantage that the adhesive element can be flexibly adjusted depending on whether it is attached to a flat, convex or concave surface, as the distance from the third magnetic element 630 and the adhesive element to the application surface varies depending on the shape of the application surface. The flexible adhesive element 634 may adhere to the bottom surface of the third magnetic element 630 by adhesive action. The adhesive element may be kneadable.

In one embodiment, the adhesive element may comprise at least one synthetic rubber type based on polybutene and/or polyisobutylene and/or isoprene and/or derivatives thereof, at least one styrene block copolymer, kerosene oil, and inorganic fillers. The inorganic fillers may comprise chalk, dolomite, baryte, talc, kaolin, clay, glass, glass powder, quartz, titanium dioxide, zinc oxide and carbon black. In another embodiment, the kneadable adhesive element may be made from flour, salt, oil, and water, which is also referred to as a kneading compound.

The third magnetic element 630 may be ferromagnetic or a permanent magnet. The third magnetic element 630 prevents the first magnetic element from moving toward the roof portion 608 when the second magnetic element is removed from the roof portion 608.

The first magnetic element 610 is disposed within the second region 604 formed by the roof region 608, the wall region 606, and the third magnetic element 630. Thus, the third magnetic element 630 may be located within the first or lower region 604.

At the roof region, a protrusion 614 may extend in the axial direction away from the second region 604 or roof region 608, which in use extends into the opening 1008 in the disk 1002 of the second magnetic element 1000. It will be understood that in the fifth embodiment, the ridges 320, 420, 422, 424 shown in FIGS. 3 and 4 may alternatively or additionally be formed on the top surface of the roof region 608.

Figure 8B:
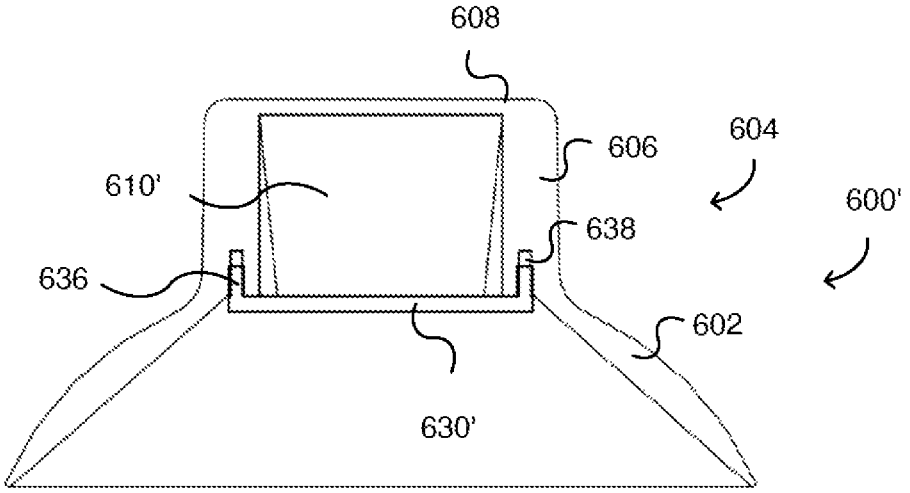
FIG. 8*b* shows a section through a holder for a soap according to a seventh embodiment.

Reference is made to FIG. 8*b*, which shows a seventh embodiment 600' that is a modification of the sixth embodiment 600. In addition to the sixth embodiment 600, the seventh embodiment includes a third magnetic member having a protrusion 636 extending in at the radially outer edge of the third magnetic member 630' in an axial direction into a first annular groove 638 in the wall region 606 and/or second region. The first annular groove 638 is open downwardly toward the first region and/or suction cup 602 in the axial direction. The first annular groove 638 frictionally holds the protrusion 636, as the width of the first annular groove 638 is smaller than the thickness of the protrusions 636. The third magnetic element 630' is located axially below a first magnetic element 610'. The third magnetic element 630' may be ferromagnetic or may be a permanent magnet.

Since the third magnetic element 630' is frictionally held in the second region, the first magnetic element 610' cannot move downward in the axial direction. Further, the second region is closed downward such that the first magnetic element 610' can be prevented from damaging an object, such as a sink.

The first magnetic element 610' is frustoconical shaped and tapers towards the first region. As a result, the first magnetic element 610' is held by the upper portion of the wall portion 606 such that the first magnetic element 610' cannot move in either the radial or axial direction.

It is conceivable to form the first magnetic element 610' in a frustoconical shape independently of the presence of the third magnetic element 630'. It is also possible to use a cylindrical first magnetic element 610 in the seventh embodiment 600' shown in FIG. 8*b*.

Figure 9:
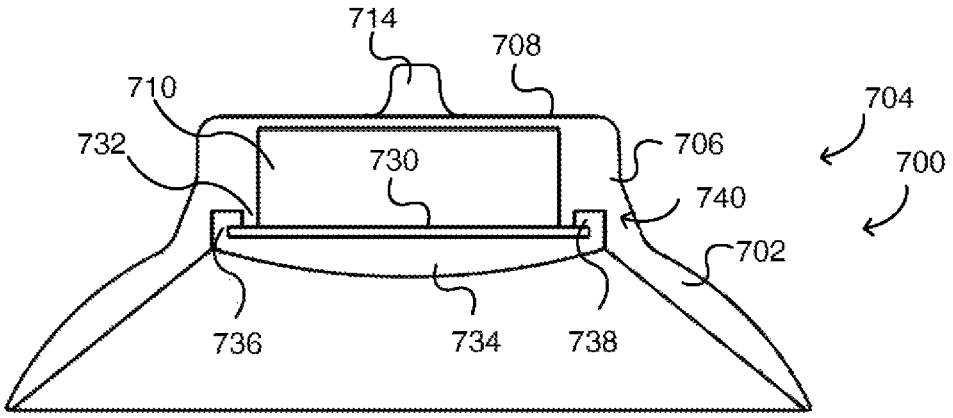
FIG. 9 shows a section through a holder for a soap according to an eighth embodiment.

Reference is made to FIG. 9, which shows a sectional view of an eighth embodiment 700 of the soap holder device according to the invention. The eighth embodiment is substantially the same as the first embodiment 100, and differs from the first embodiment in that a third magnetic element 730 is disposed below a first magnetic element 710. The eighth embodiment includes a suction cup 702 formed in the lower portion of the soap holder 700. The thickness of the suction cup 702 decreases in a radially outward direction. Extending upwardly in the axial direction from the upper end of the suction cup 702 is a wall portion 706 that is substantially cylindrical in shape.

Above the wall portion 706, the roof portion 708 is formed to form a cylinder with the wall portion 706 and the third magnetic element 730. The third magnetic element 730 is formed as a cylindrical disk disposed below the first magnetic element 710. A cylindrical support portion 732 may extend downwardly from the wall portion 706 toward the first portion, and the third magnetic element 730 is disposed at the lower end of the cylindrical support portion 732. The cylindrical support region 732 decouples the forces acting from the suction cup 702 into the wall region 706 from the third magnetic element 730.

In this embodiment, the third magnetic element 730 is supported by a receiving element 734 disposed below the third magnetic element 730. The receiving element 734 surrounds the edge of the third magnetic element 730 in a substantially U-shaped cross-section 736, 738. A cross-sectionally U-shaped portion 736, 738 of the receiving element surrounds the edge of the third magnetic element 730. As a result, the third magnetic element 730 is fixedly secured in the receiving element 734.

The wall portion 706 comprises a second annular groove 740 extending upwardly from the suction cup 702. The second annular groove 740 is located radially outward of the support portion 732, which is located radially outward of the first magnetic member 710. A portion of the U-shaped portion 736, 738 of the receiving element 734 is located in the second annular groove 740. The second annular groove 740 clamps the radially outer portion 736, 738 of the receiving element 734, in particular, the second annular groove 734 clamps a portion of the portion 736, 738 of the receiving element 734 that surrounds the edge of the third magnetic element 730 in a U-shape. As a result, the third magnetic element 730 is stably held in the desired position.

The third magnetic element 730 may be ferromagnetic or a permanent magnet. The third magnetic element 730 prevents the first magnetic element 710 from moving toward the roof portion 708 when the second magnetic element is removed from the roof portion 708.

The receiving element 734 includes a convex protrusion that extends axially downward toward the suction cup 702. The protrusion of the receiving element 734 may prevent the second magnetic element 710 from moving out of the second region 704 toward the suction cup 702 when the soap holder device 700 is attached to a wall, sink, or other object by the suction cup 702.

The first magnetic member 710 is disposed within the second region 704 formed by the roof region 708, the wall region 706, and the third magnetic member 730. At the roof region, a protrusion 714 may extend in the axial direction away from the second region 704 or roof region 708, which, in use, extends into the opening 1008 in the disk 1002 of the second magnetic element 1000. It will be understood that in the eighth embodiment, the ridges 320, 420, 422, 424 shown in FIGS. 3 and 4 may alternatively or additionally be formed on the top surface of the roof region 708.

Figure 10:
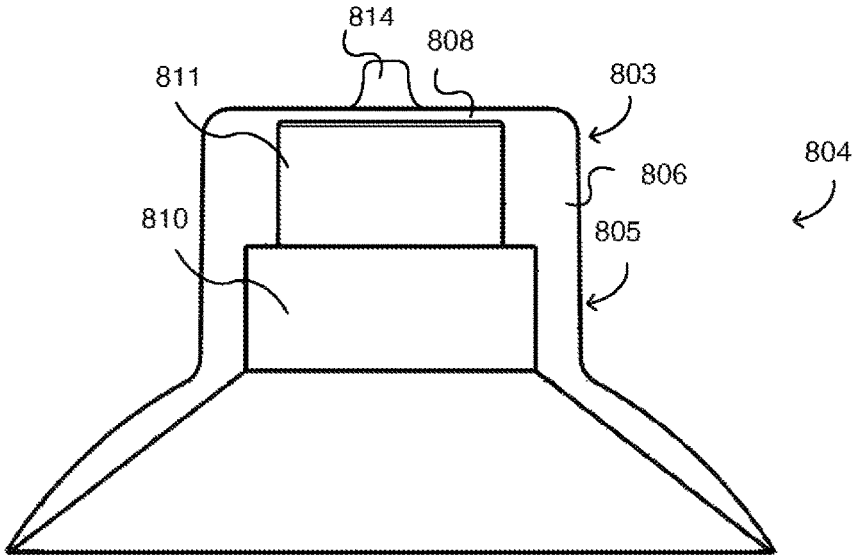
FIG. 10 shows a section through a holder for a soap according to a ninth embodiment.

Reference is made to FIG. 10. The fourth magnetic element 811 is arranged in the tub-shaped region between the roof region 808 and the first magnetic element 810. The fourth magnetic element 811 may be ferromagnetic. The fourth magnetic element 811 may be a permanent magnet. Consequently, the first magnetic element 810 and the fourth magnetic element 811 adhere to each other.

The tub-shaped portion may comprise an upper portion 803 at an upper portion facing the roof member, and a lower portion 805 at a lower portion thereof facing away from the roof member. The first magnetic member 810 may be disposed in the lower portion 805 of the tub-shaped region, and the fourth magnetic member 811 may be disposed in the upper portion 803 of the tub-shaped region. This may prevent the first magnetic element 810 from moving toward the roof portion 808 when the second magnetic element is pulled away from the roof portion 808. As a result, the service life of the soap holder device may be extended and handling by the user may be simplified.

Embodiments are conceivable in which the first magnetic element 810 and the fourth magnetic element 811 comprise the same diameter, or the first magnetic element 810 comprises a smaller diameter than the fourth magnetic element 811, or the fourth magnetic element comprises a smaller diameter than the first magnetic element.

At the roof portion, a protrusion 814 may extend in the axial direction away from the second portion 804, which in use extends into the opening 1008 in the disk 1002 of the second magnetic element 1000. It is understood that in the ninth embodiment, the ridges 320, 420, 422, 424 shown in FIGS. 3 and 4 may alternatively or additionally be formed on the top surface of the roof region 808.

Figure 11:
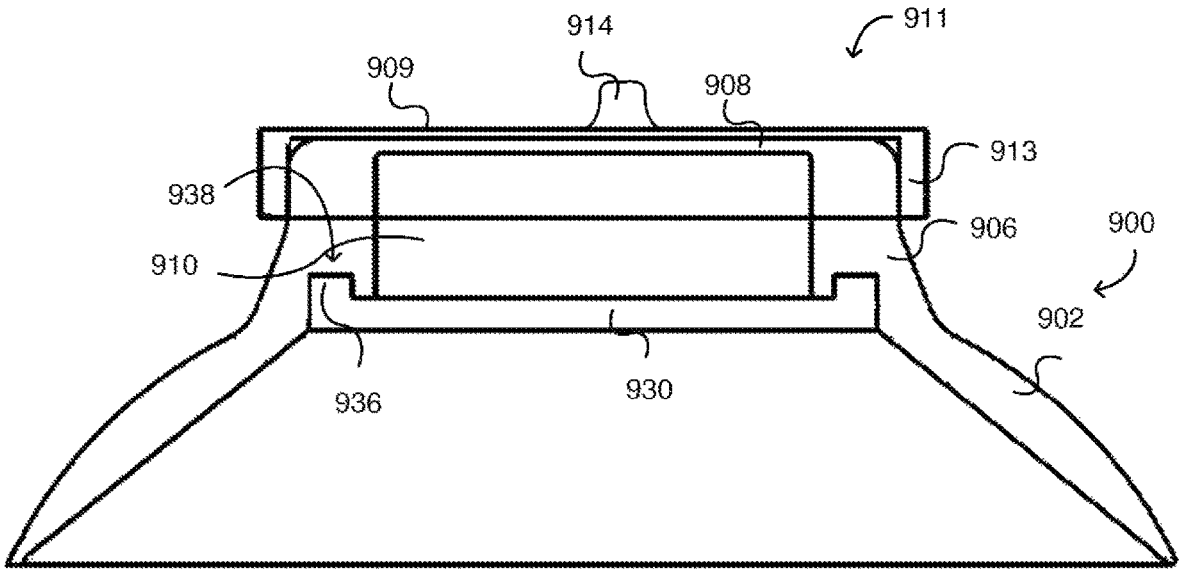
FIG. 11 shows a section through a holder for a soap according to a tenth embodiment.

FIG. 11 shows a tenth embodiment of the soap holder 900 according to the invention in a sectional view. A suction cup 902 is formed in the lower portion of the soap holder 900. The thickness of the suction cup 902 decreases in the radially outward direction. This has the advantage that the suction cup 902 comprises sufficient stability to support heavy loads, on the one hand, and sufficient flexibility to conform to a surface of a body, on the other hand. Extending upwardly in the axial direction from the suction cup 902 is a wall portion 906 that is substantially cylindrical in shape. Above the wall region 906 is formed a roof region 908, which forms a downwardly open cylinder with the wall region 906.

A first magnetic element 910 is disposed within the wall region 906 and the roof region 908 and. In a preferred embodiment, the first magnetic element 910 is a permanent magnet.

The tenth embodiment comprises a third magnetic element having a protrusion 936 extending in at the radially outer edge of the third magnetic element 930 in an axial direction into a first annular groove 938 in the wall region 906 and/or second region. The first annular groove 938 is open downwardly toward the first region (suction cup 902) in the axial direction. The first annular groove 938 frictionally holds the protrusion 936, as the width of the first annular groove is smaller than the thickness of the protrusions 936. The third magnetic element 930 is located axially below a first magnetic element 910. The third magnetic element 930 may be ferromagnetic or may be a permanent magnet.

Since the third magnetic element 930 is frictionally held in the second region, the first magnetic element 910 cannot move downward in the axial direction. Further, the second region is closed downward such that the first magnetic element 910 can be prevented from damaging an object, such as a sink.

In addition to the preceding embodiments 100, 200, 200', 300, 400, 500, 600, 600', 700, 800, the tenth embodiment 900 includes a cap element 911 disposed over the roof portion 908 and at least a portion of the wall portion 906. A sidewall of the cowl element 913 contacts and is frictionally held by the wall region 906. An end portion 909 of the cowl element 911 is disposed over the roof portion 908.

The cap element 911 protects the roof portion 906 from an excessive force generated by the attractive force of the first magnetic element 910 and the second magnetic element 1000. This ensures a longer service life of the soap holder 900. The cap element 911 may be removed from the wall portion 906, and another cap element 911 may be disposed on the wall portion 906.

At the end portion 909 of the cap element 911, a protrusion 914 may extend in the axial direction away from the end portion 909, which in use extends into the opening 1008 in the disk 1002 of the second magnetic element 1000. It will be understood that in the tenth embodiment, the ridges 320, 420, 422, 424 shown in FIGS. 3 and 4 may alternatively or additionally be formed on the top surface of the end face 909.

It is understood that the cap element 911 may be applied to any of the previously described embodiments. The protrusions 114, 320, 420, 422, 424, 514, 614, 714, 814 may be disposed on the front surface 909 rather than on the roof portion.

Preferably, the soap holder according to the foregoing embodiments 100, 200, 200', 300, 400, 500, 600, 600' 700, 800, 900 and the cap member 911 are made by means of a plastic, for example a polymer, and preferably the soap holder 100, 200, 200', 300, 400, 500, 600, 600', 700, 800, 900 and the cap member 911 are elastic.

In another embodiment, the cap element 911 may comprise, at least in part, a ferromagnetic material. The cap element 911 may be made of a plastic, for example a polymer, wherein a ferromagnetic material is enclosed by the plastic. The ferromagnetic material may comprise iron, for example steel. In another embodiment, the cap element 911 may be made of iron or steel.

If the cap element 911 comprises ferromagnetic properties, a frictional hold on the wall portion 906 is not required because the first magnetic element 910 pulls the cap element towards the roof portion 908.

The present invention has the advantage that a soap can be held stably, and the soap can dry from all directions without contaminating the sink or the soap receptacle. The soap holder can be arranged on the sink or inside the sink by means of the suction cup 102, 202, 202', 302, 402, 502, 602, 702, 802. To increase the stability of the fixation of the soap receptacle to the roof portion 108, 208, 208', 308, 408, 508, 608, 708, 808, the top surface of the roof portion may be roughened in addition to the ridges or alternatively to the ridges.

Although specific advantages have been enumerated above, various embodiments may include some, none, or all of the enumerated advantages. Other technical advantages may become readily apparent to one of ordinary skill in the art after review of the following figures and description. It is understood that, although exemplary embodiments are illustrated in the figures and described below, the principles of the present disclosure may be implemented using any number of techniques, whether currently known or not. Modifications, additions, or omissions may be made to the systems, apparatuses, and methods described herein without departing from the scope of the invention. The components of the systems and apparatuses may be integrated or separated. The operations of the systems and apparatuses disclosed herein may be performed by more, fewer, or other components and the methods described may include more, fewer, or other steps. Additionally, steps may be performed in any suitable order. As used in this document, "each" refers to each member of a set or each member of a subset of a set. It is intended that the claims and claim elements recited below do not invoke 35 U.S.C. § 112(f) unless the words "means for" or "step for" are explicitly used in the particular claim. The above-described embodiments, while including the preferred embodiment and the best mode of the invention known to the inventor at the time of filing, are given as illustrative examples only. It will be readily appreciated that many deviations may be made from the specific embodiments disclosed in this specification without departing from the spirit and scope of the invention. Accordingly, the scope of the invention is to be determined by the claims below rather than being limited to the specifically described embodiments above.

What is claimed is:

1. A soap holder device, comprising:

a holder having a first magnetic member;

a second magnetic member adapted to be pressed into a soap;

the holder comprising:

a first portion in which a conically shaped lip forms a suction cup, and a second portion located radially inward of the first portion and axially spaced from the first portion, the second portion being adapted to hold the first magnetic member in a radial direction by means of a wall portion and in an axial direction by means of a roof portion in a direction opposite to the first portion;

wherein the conically shaped lip of the first portion decreases in diameter toward the second portion;

wherein, in use, the second magnetic member is detachably disposed on the roof portion of the second portion, wherein the second portion is formed substantially as a tub-shaped portion, wherein an open end of the second portion is formed in the axial direction toward the first portion, a wall portion of a substantially tub-shaped second portion is formed in the axial direction from an inner end of the first portion, and an axially closed end of the tub-shaped second portion is opposed to the first portion in the axial direction, wherein the tub-shaped portion is formed substantially cylindrical at an outer contour thereof.

2. The soap holder device according to claim 1, wherein an inner cross-section of the second portion is shaped at least one of the following:

conically tapered in the axial direction towards the roof portion of the second portion; and conically tapered in the axial direction in the direction of the first portion.

3. The soap holder device according to claim 1, wherein a circumferential sealing lip is arranged in the second portion at an opening opposite the roof portion, which lip extends radially inwards from the wall portion.

4. The soap holder device according to claim 1, wherein the second region fluid-tightly encloses the first magnetic member.

5. The soap holder device according to claim 1, further comprising a third magnetic member arranged below the first magnetic member and which comprises a larger cross-section or a larger diameter than an inner diameter of the second portion.

6. The soap holder device according to claim 5, wherein an outer periphery of said third magnetic member presses against an inner portion of said first portion.

7. The soap holder device according to claim 6, wherein the third magnetic member comprises a protrusion that protrudes into a first groove in the second region.

8. The soap holder device according to claim 6, further comprising a receiving member that receives an edge of the third magnetic member on an inside of the receiving member in a form-fit manner.

9. The soap holder device according to claim 8, wherein the third magnetic member is substantially cylindrical disc-shaped and the receiving member extends in a U-shape around an axially outer edge of the third magnetic member.

10. The soap holder device according to claim 9, wherein an outer side of the receiving member is frictionally coupled to the inner side of the first region at least one of, wherein the outer side of the receiving member is coupled to the inner side of the first region in the form-fit manner.

11. The soap holder device according to claim 10, wherein a second annular groove is arranged in a wall region, which groove extends axially upwards from the first region and which is spaced apart from the first magnetic member, at least part of the receiving member being positively received by the second annular groove.

12. The soap holder device according to claim 5, wherein a projection extends from a receiving member into the first region on the side facing away from the second region.

13. The soap holder device according to claim 1, further comprising a flexible adhesive element that is on an underside of the third magnetic member, on an underside of a receiving member, on an underside of the sealing area, or on an underside of the first magnetic member.

14. The soap holder device according to claim 13, further comprising a fourth magnetic member disposed in the tub-shaped portion between the roof portion and the first magnetic member.

15. The soap holder device according to claim 14, wherein the tub-shaped portion comprises a first diameter at an upper portion facing a roof member and comprises a second diameter at a lower portion thereof facing away from the roof member, wherein the first magnetic member is disposed in the lower portion of the tub-shaped portion and the fourth magnetic member is disposed in the upper portion of the tub-shaped portion.

16. The soap holder device according to claim 1, further comprising a fifth magnetic member disposed between the roof portion and the second magnetic member.

17. The soap holder device according to claim 1, further comprising a cap member disposed over the roof portion and on at least a portion of the wall portion.

* * * * *